US005620350A

United States Patent [19]

Takemura

[11] Patent Number: 5,620,350

[45] Date of Patent: Apr. 15, 1997

[54] METHOD FOR MAKING A FIELD-EMISSION TYPE ELECTRON GUN

[75] Inventor: Hisashi Takemura, Tokyo, Japan

[73] Assignee: NEC Corporation, Tokyo, Japan

[21] Appl. No.: 548,722

[22] Filed: Oct. 26, 1995

[30] Foreign Application Priority Data

Oct. 27, 1994 [JP] Japan ..... 6-286173

[51] Int. Cl.[6] ..... H01J 1/30; H01J 9/02

[52] U.S. Cl. ..... 445/50; 313/309; 313/336

[58] Field of Search ..... 445/50, 51; 313/309, 313/336

[56] References Cited

U.S. PATENT DOCUMENTS

| | | | |
|---|---|---|---|
| 3,921,022 | 11/1975 | Levine | 313/309 |
| 4,008,412 | 2/1977 | Yuito et al. | 313/336 |
| 5,199,917 | 4/1993 | MacDonald et al. | 313/336 |

FOREIGN PATENT DOCUMENTS

| | | |
|---|---|---|
| 3-222232 | 10/1991 | Japan . |
| 4-94033 | 3/1992 | Japan . |
| 6-52788 | 2/1994 | Japan . |

OTHER PUBLICATIONS

C.A. Spindt et al., "Physical properties of thin-film field emission cathodes with molybdenum cones", *Journal of Applied Physics,* vol. 47, No. 12, Dec. 1976, pp. 5248–5265.

*Primary Examiner*—P. Austin Bradley
*Assistant Examiner*—Jeffrey T. Knapp
*Attorney, Agent, or Firm*—Sughrue, Mion, Zinn, Macpeak & Seas

[57] ABSTRACT

A method for making a field-emission type electron gun has the steps of: a) forming insulating film on a main plane of a silicon substrate; b) selectively etching the insulating film within a region where a gate electrode will be formed to form a mask of the insulating film; c) removing the silicon substrate within the region with using the mask to form a concave portion, wherein the insulating film leaves on an edge of the concave portion and an edge of the insulating film extends in the form of a cantilever from the edge of the concave portion; d) oxidizing a surface of the silicon substrate by thermal oxidation to form an emitter with a sharpened tip; e) depositing film for forming a gate electrode to fill the concave portion; f) removing an unnecessary part of the film for forming the gate electrode; and g) selectively removing the oxidized surface of the silicon substrate on the emitter to expose the tip of the emitter.

6 Claims, 8 Drawing Sheets

METHOD FOR MAKING A FIELD-EMISSION TYPE ELECTRON GUN

FIELD OF THE INVENTION

This invention relates to a method for making a field-emission type electron gun, and more particularly to, a method for making a field-emission type electron gun in which a silicon substrate is employed.

BACKGROUND OF THE INVENTION

A field-emission type electron gun is a cold-cathode electron gun which emits electrons by a field effect, and it is an important element of a micro vacuum device such as a vacuum switching device, vacuum amplifier device, micro display device or the like.

C. A. Spindt et al., Journal of Applied Physics, Vol. 47, No. 12, pp. 5248–5265, 1976 reports a field-emission type electron gun in which an emitter is made of molybdenum. However, since this type of electron gun requires that molybdenum cone is formed on a conductive substrate, a high-precision processing thereof is too difficult.

Recently, various methods for forming the emitter by employing silicon with good processability are suggested. For example, Japanese patent application laid-open No. 4-94033 discloses a method (hereinafter referred to as "first prior art") as shown in FIGS. 1A to 1D and 2A and 2B.

First, as shown in FIG. 1A, silicon dioxide film 2 is deposited on a silicon substrate 1 of, for example, N-type. Thereafter, as shown in FIG. 1B, the silicon dioxide film 2 is patterned by photolithography to leave a part of the silicon dioxide film 2 where an emitter will be formed.

Next, as shown in FIG. 1C, the silicon substrate 1 is isotropically etched to form a convex portion, followed by applying thermal oxidation to the surface of the silicon substrate 1 to form silicon dioxide film 3 thereon as shown in FIG. 1D. Due to this step, the convex portion of the silicon substrate 1 is sharpened to form a conical emitter 1*a*.

Thereafter, as shown in FIG. 2A, insulating film 6 made of, for example, silicon dioxide is deposited by the deposition method, followed by depositing film 4*a* for gate electrode by, for example, deposition method to form a gate electrode 4 thereon. Thereafter, as shown in FIG. 2B, the silicon dioxide films 2, 3 and insulating film 6 on the emitter are etched by hydrofluoric acid to lift-off the film 4*a* for gate electrode over the emitter region to expose the emitter 1*a*. In this method, to form the emitter made of silicon and the gate, the deposition method and lift-off method are employed.

Hereon, Japanese patent application laid-open No. 6-52788 discloses that a gate electrode is formed at a concave portion by the etch-back method in place of the lift-off method in the first prior art.

On the other hand, Japanese patent application laid-open No. 3-222232 discloses another method( hereinafter referred to as "second prior art") as shown in FIGS. 3A to 3E.

First, as shown in FIG. 3A, photoresist film 7 in which an opening is formed by photolithography at the region where an emitter will be formed is formed on a silicon substrate 1 with (100) face orientation. Using the photoresist film 7 as a mask, the surface of the silicon substrate 1 is then etched by an etchant such as tartaric acid, sulfuric acid to form a conical or V-shaped groove thereon.

Next, as shown in FIG. 3B, the photoresist film 7 is removed, followed by forming tungsten film to provide an emitter electrode on the silicon substrate 1. Thereafter, as shown in FIG. 3C, the silicon substrate 1 is polished from the back surface of the silicon substrate 1 toward below the emitter electrode. Subsequently, as shown in FIG. 3D, the silicon substrate 1 is further thinned by polishing or wet-etching to expose the tip of the emitter electrode 8.

Thereafter, silicon dioxide film 9 is deposited on the back surface of the silicon substrate 1, and photoresist is coated thereon and etched back to expose a part of the silicon dioxide film 9 on the tip of the emitter electrode 8, followed by selectively etching the exposed part of the silicon dioxide film. Finally, after forming metal film of aluminum etc. on the silicon dioxide film 9, a grid electrode 10 and anode electrode 11 are formed by photolithography and dry-etching to obtain an electron gun as shown in FIG. 3E. In the above method, the exposing of the emitter electrode is by both the polishing and etch-back method.

In general, to well control electrons emitted form an emitter, such a field-emission type electron gun has to be formed such that the distance between an emitter and a gate is sufficiently shortened and the height difference between the emitter and the gate is within a given range. Furthermore, in mass production, the plane uniformity of a wafer as well as the reduction of fluctuation in quality between wafers is required. Thus, it is desired that the positioning of the tip of an emitter and a gate is self-aligned.

In the first prior art, though the gate electrode is formally formed self-aligned, the distance between the emitter and the gate can not be sufficiently shortened and the height of the gate can not be precisely controlled. In the first prior art, the distance between the emitter and the gate is determined by a mask size of the silicon dioxide film 2 for forming the emitter. However, this size can not be optionally decreased because it is an important factor to determine the height and shape of the emitter cone. Moreover, it is difficult to constantly keep the height difference between the emitter and the gate electrode since the respective thicknesses of the silicon dioxide film 3 and insulating film 6 by which the height of the gate electrode is determined may fluctuate in the film formation process thereof.

In the second prior art, since the grid electrode corresponding to a gate electrode is not formed self-aligned, it is difficult to constantly shorten the distance between the emitter and the grid without fluctuation. Furthermore, in the second prior art, it is difficult to constantly keep the height difference between the tip of the emitter and the grid electrode 10, since the thickness of the silicon substrate may fluctuate when it is polished because the stopper for the polishing does not exist, and further, the thickness of the silicon dioxide film may fluctuate. Moreover, the tip of the emitter may be damaged by an error in the process that the silicon substrate 1 is polished.

SUMMARY OF THE INVENTION

Accordingly, it is an object of the invention to provide a method for making a field-emission type electron gun in which the distance between an emitter and a gate electrode is sufficiently shortened and the height of the gate electrode is placed at a given position to enhance the controllability in emission of electrons.

It is a further object of the invention to provide a method for making a field-emission type electron gun in which a gate electrode is formed self-aligned to an emitter to keep the plane uniformity and to reduce the dispersion in quality between wafers.

According to the invention, a method for making a field-emission type electron gun, comprises the steps of:

a) forming insulating film on a main plane of a silicon substrate;

b) selectively etching the insulating film within a region where a gate electrode will be formed to form a mask of the insulating film;

c) removing the silicon substrate within the region with using the mask to form a concave portion, wherein the insulating film leaves on an edge of the concave portion and an edge of the insulating film extends in the form of a cantilever from the edge of the concave portion;

d) oxidizing a surface of the silicon substrate by thermal oxidation to form an emitter with a sharpened tip;

e) depositing film for forming a gate electrode to fill the concave portion;

f) removing an unnecessary part of the film for forming the gate electrode; and g) selectively removing the oxidized surface of the silicon substrate on the emitter to expose the tip of the emitter.

BRIEF DESCRIPTION OF THE DRAWINGS

The invention will be explained in more detail in conjunction with the appended drawings, wherein.

DESCRIPTION OF THE PREFERRED EMBODIMENTS

A method for making a field-emission type electron gun in the first preferred embodiment will be explained in FIGS. 4A to 4D and 5A to 5C.

Figure 1A:
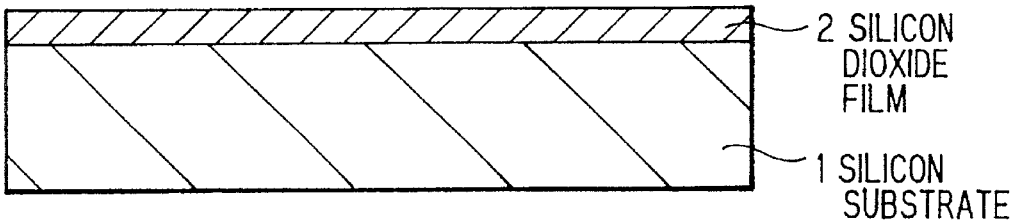
FIG. 1A PRIOR ART
FIGS. 1A to 1D and 2A, 2B are cross sectional views showing the method for making the field-emission type electron gun in the first prior art.
Figure 1B:
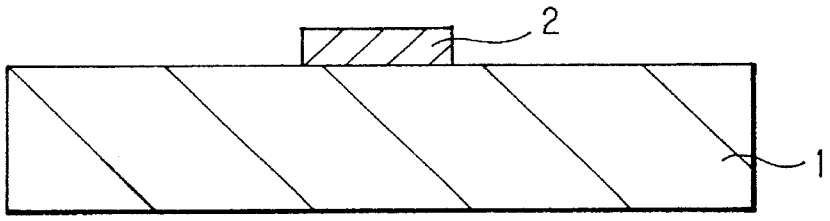
FIG. 1B PRIOR ART
Figure 1C:
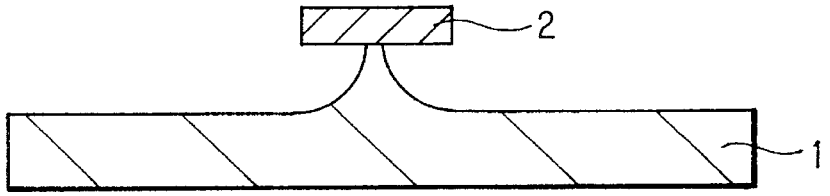
FIG. 1C PRIOR ART
Figure 1D:
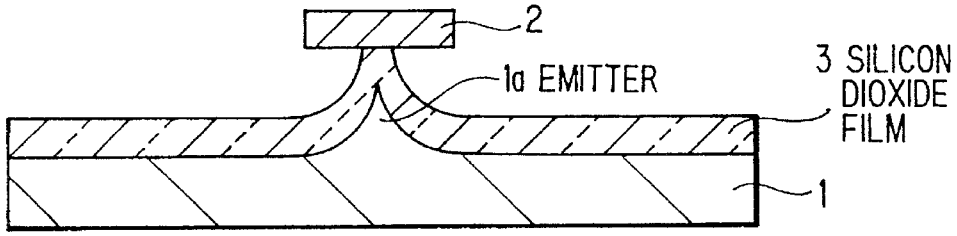
FIG. 1D PRIOR ART
Figure 2A:
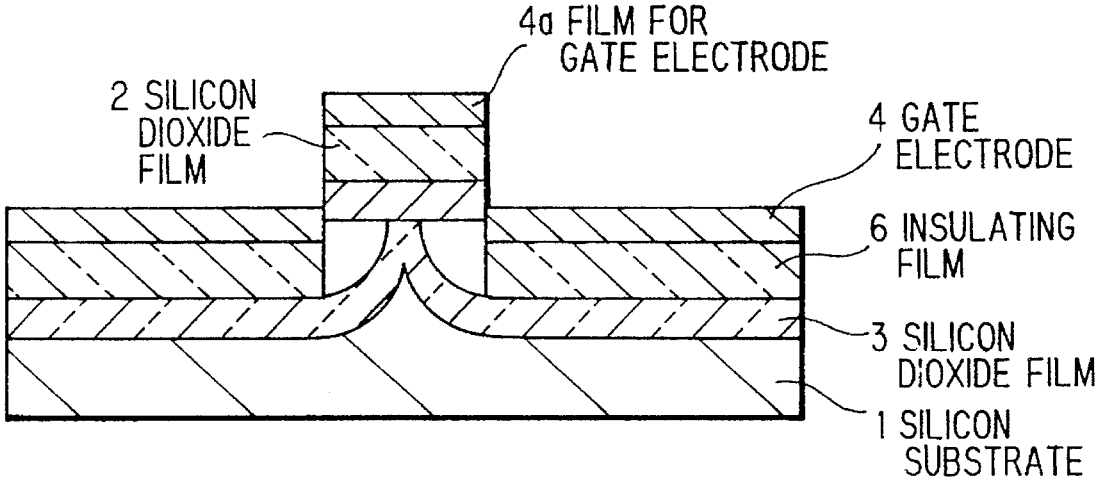
FIG. 2A PRIOR ART
Figure 2B:
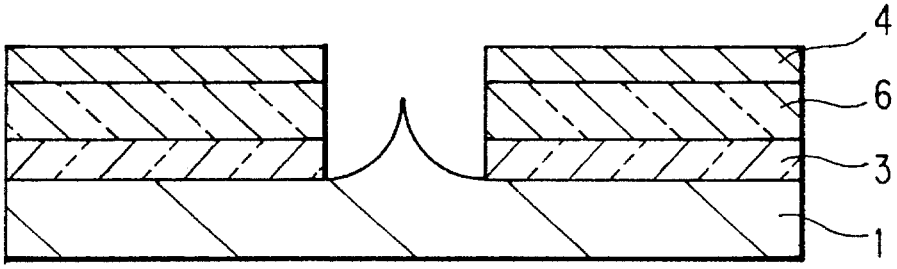
FIG. 2B PRIOR ART
Figure 3A:
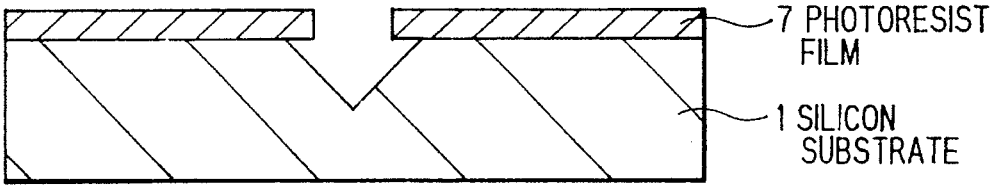
FIG. 3A PRIOR ART
FIGS. 3A to 3E are cross sectional views showing the method for making the field-emission type electron gun in the second prior art.
Figure 3B:
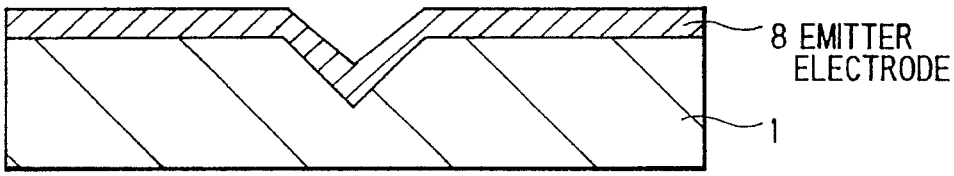
FIG. 3B PRIOR ART
Figure 3C:
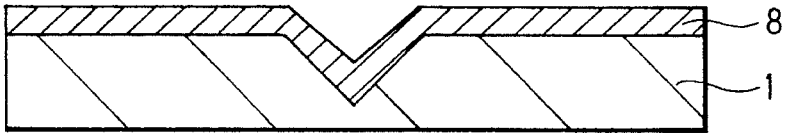
FIG. 3C PRIOR ART
Figure 3D:
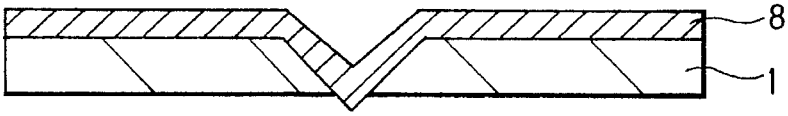
FIG. 3D PRIOR ART
Figure 3E:
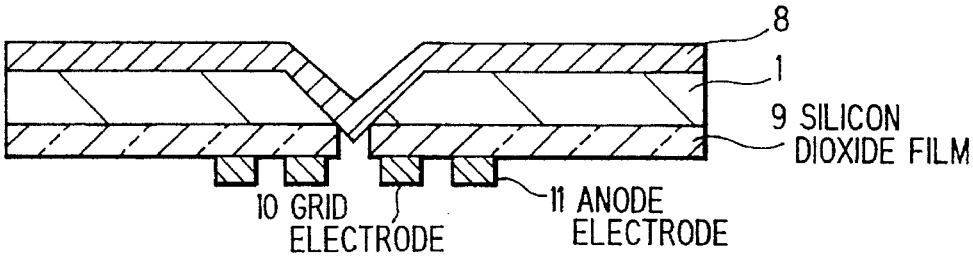
FIG. 3E PRIOR ART
Figure 4A:
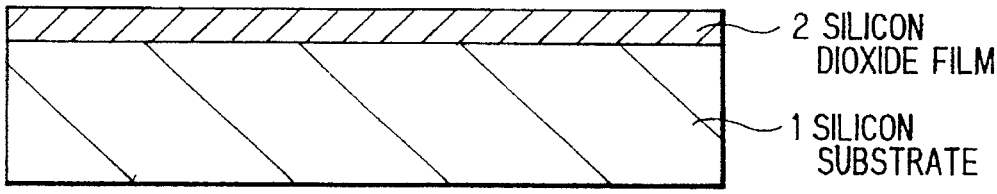
FIGS. 4A to 4D and 5A to 5C are cross sectional views showing a method for making a field-emission type electron gun in a first preferred embodiment of the invention.

First, as shown in FIG. 4A, silicon dioxide film 2 with a thickness of about 200 nm which serves as a stopper against polishing is formed by thermal oxidation on the surface of a silicon substrate 1.

Figure 4B:
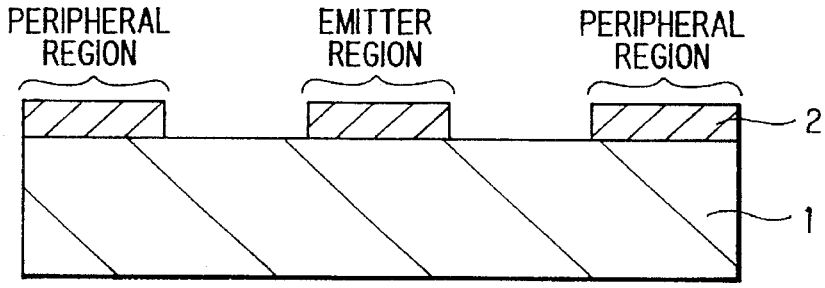

Thereafter, as shown in FIG. 4B, the silicon dioxide film 2 partially masked with photoresist(not shown) is etched to be partially removed. In this step, the remaining parts of the silicon dioxide film 2 correspond to a region for forming an emitter and a peripheral region thereof, and the removed part corresponds to a region for forming a gate electrode.

Figure 4C:
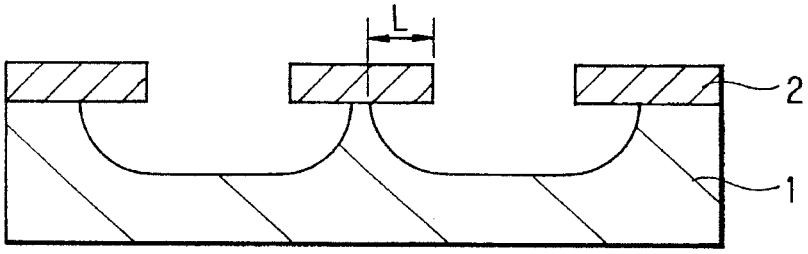

Then, as shown in FIG. 4C, the exposed silicon substrate is isotropically etched by RIE (Reactive Ion Etching) with a gas such as SF6. In this etching, the process is controlled such that the silicon substrate 1 is side-etched by a given depth of L. Thereby, a concave portion for forming a gate electrode is formed and a convex portion for forming an emitter surrounded by the concave portion is formed.

Figure 4D:
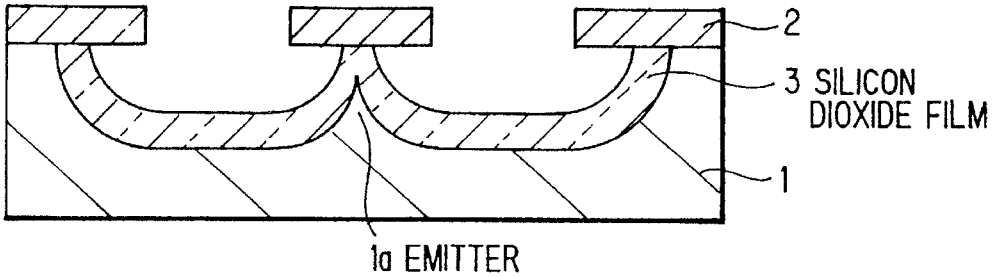

Next, as shown in FIG. 4D, silicon dioxide film 3 with a thickness of 0.3 to 0.6 μm is formed by thermal oxidation on the silicon substrate 1. In this step, the emitter 1*a* which is in the form of a cone with sharpened nip is formed.

Figure 5A:
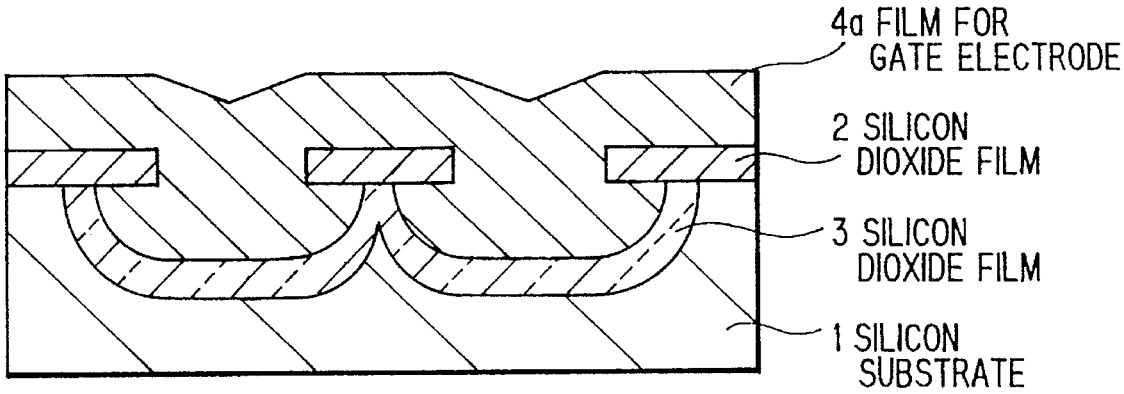

Thereafter, as shown in FIG. 5A, film 4*a* for forming a gate electrode is deposited 1 to 2 μm in thickness. The film 4*a* may be formed by CVD method to deposit polycrystalline silicon film in which an additive such as phosphorus atom is included, or formed by CVD method or the sputtering method to deposit metal film made of molybdenum or tungsten. Herein, to perform the deposition without leaving a void particularly under the silicon dioxide film 2, it is preferable to form tungsten film by CVD method which is excellent in fully filling inside a narrow corner when a metal-film gate is selected. On the other hand, when silicon doping is selected, low-pressure or ultra-high vacuum CVD method is preferable.

Figure 5B:
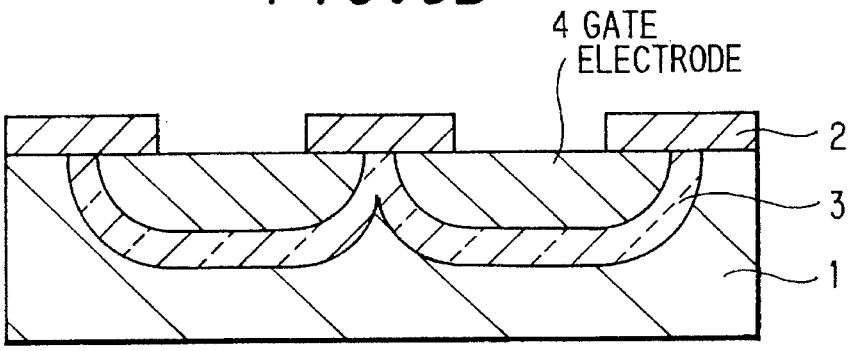

Subsequently, as shown in FIG. 5B, the film 4*a* for gate electrode is thinned by polishing. In this step, since the silicon dioxide film 2 becomes a stopper against polishing, the film 4*a* is not excessively thinned. Further, by etching to a given height, the gate electrode 4 is formed.

Figure 5C:
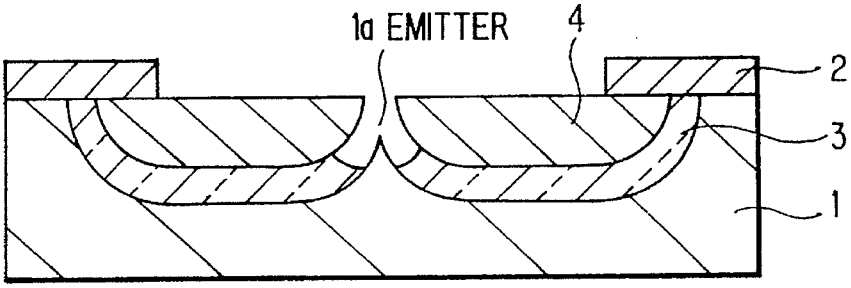

Thereafter, as shown in FIG. 5C, the silicon dioxide film 2 over the emitter is selectively removed by using an etchant such as hydrofluoric acid, followed by etching the exposed silicon dioxide film 3 to expose the emitter 1*a* of silicon.

Herein, the height of the upper surface of the gate electrode 4 is determined by the level of the lower surface of the silicon dioxide film 2 which is determined by the thickness of the silicon dioxide film 3. As a result, the gate electrode 4 can have a self-aligned height to the emitter 1*a*. Also, since the distance between the gate electrode 4 and the emitter 1*a* is determined by the thickness of the silicon dioxide film 3, the distance therebetween can be controlled to be sufficiently shortened without fluctuation. Furthermore, the tip of the emitter 1*a* is not damaged by the polishing since it is protected by the silicon dioxide films 2 and 3.

Figure 6A:
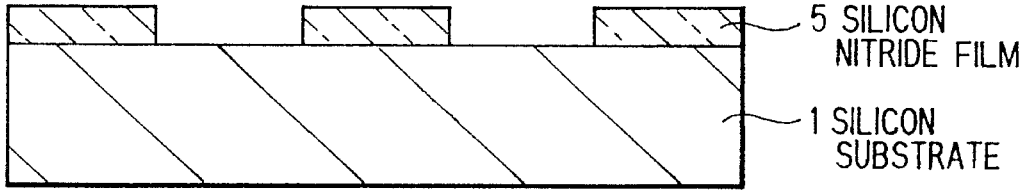
FIGS. 6A to 6D are cross sectional views showing a method for making a field-emission type electron gun in a second preferred embodiment according to the invention.

A method for making a field-emission type electron gun in the second preferred embodiment will be explained in FIGS. 6A to 6D. First, as shown in FIG. 6A, silicon nitride film 5 is deposited about 100 nm in thickness on the silicon substrate 1 by CVD method. Optionally, silicon dioxide film may be formed between the silicon substrate 1 and silicon nitride film 5. Then, the silicon nitride film 5 is selectively removed by plasma-etching method in which photoresist-(not shown) is used as a mask.

Figure 6B:
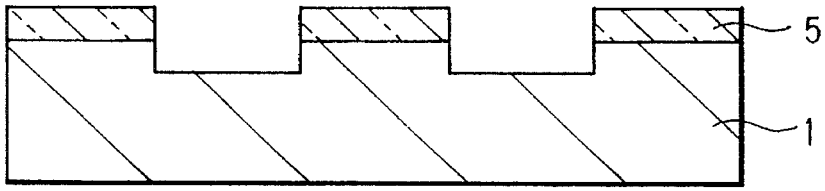
Figure 6C:
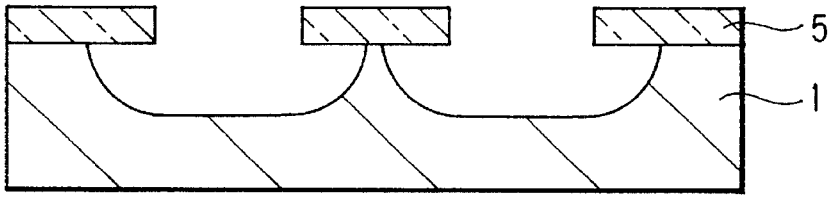

Next, as shown in FIG. 6B, the silicon substrate 1 is etched to a depth of about 100 to about 400 nm by the anisotropic plasma-etching method. Thereafter, as shown in FIG. 6C, silicon dioxide film (not shown) with a thickness of 0.3 to 0.8 μm is formed on the silicon substrate 1 by thermal oxidation, followed by removing the silicon dioxide film by hydrofluoric acid to form a convex region for forming an emitter. Herein, the previous step as shown in FIG. 6B by which a rectangular groove is formed can contribute to providing a higher convex region for forming an emitter, thereby forming a more sharpened emitter. Furthermore, by forming the rectangular groove in the silicon substrate 1 by the anisotropic etching method, followed by thermal oxidation and further removing the thermal-oxidized film, the side-etching is suppressed to form the convex region in which the fluctuation in lateral thickness by etching is reduced.

Figure 6D:
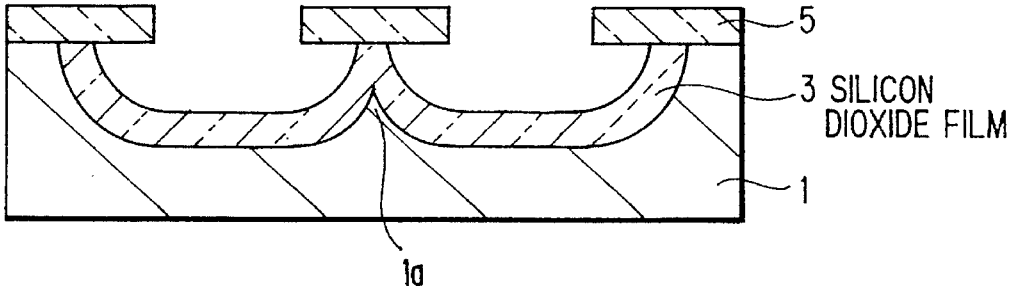

Then, as shown in FIG. 6D, silicon dioxide film 3 with a thickness of 0.3 to 0.6 μm is formed by thermal oxidation.

By the above process, a higher and more sharpened emitter 1*a* can be obtained in comparison with that in the first embodiment as shown in FIG. 4D. Thereafter, similarly to the process as shown in to 5C, a gate electrode is formed and the emitter 1*a* is exposed to provide a field-emission type electron gun.

In the second embodiment, the convex region for forming the emitter is formed by the combination of the anisotropic etching method and thermal oxidation, whereas in the first embodiment it is formed by the isotropic etching method. In general, the oxidation process can afford more excellent uniformity in process than the isotropic etching method. Therefore, in the second embodiment, there is an advantage that the convex region for forming the emitter can be with good reproducibility. Thereby, the fluctuation in height difference between the gate electrode and the emitter can be more reduced to enhance the accuracy in positioning of them.

Alternatively, the process in FIG. 6C may be substituted by the isotropic etching process. In this case, since the isotropic etching process is combined with the anisotropic etching, the accuracy in positioning is developed compared with that in the first embodiment in which the convex region for emitter is formed by the isotropic etching.

Figure 7A:
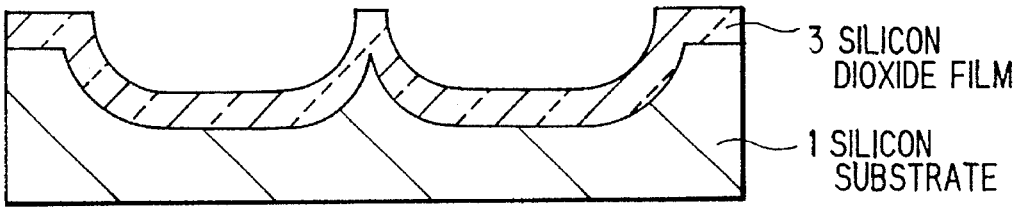
FIGS. 7A to 7D are cross sectional views showing a method for making a field-emission type electron gun in a third preferred embodiment according to the invention.

A method for making a field-emission type electron gun in the third preferred embodiment will be explained in FIGS. 7A to 7D. In the third embodiment, the process in FIGS. 6A to 6C is similarly used. FIG. 7A shows the state that the silicon nitride film shown in FIG. 6C is removed by phosphoric acid and silicon dioxide film 3 with a thickness of 0.3 to 0.6 μm is then formed by thermal oxidation of the silicon substrate 1.

Figure 7B:
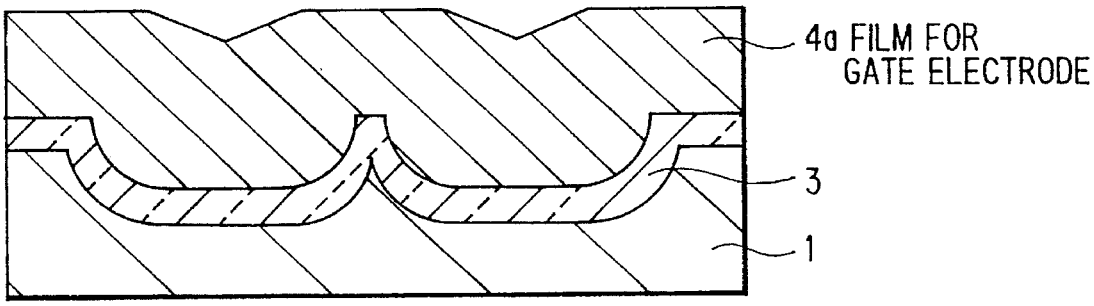

Thereafter, as shown in FIG. 7B, film 4*a* for forming a gate electrode which is made of doped polycrystalline silicon, metals with high melting point etc. is deposited. In this deposition step, since the silicon dioxide film 2 or silicon nitride film 5 which is left as a mask in the first or second embodiment does not exist, it is not necessary to carefully fill the film material inside a narrow corner formed under the silicon dioxide film 2 or silicon nitride film 5 when the film 4*a* for the gate electrode is deposited. Therefore, the condition in the deposition step is relaxed.

Figure 7C:
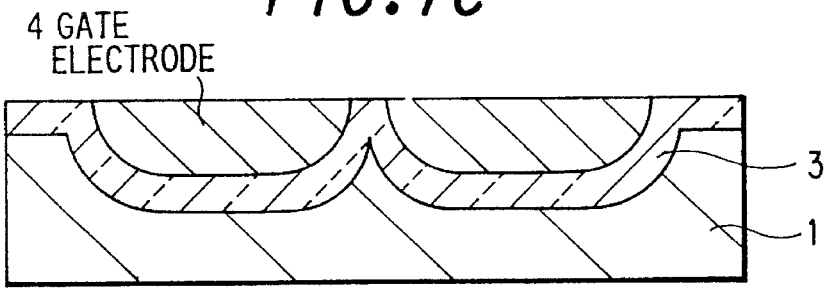
Figure 7D:
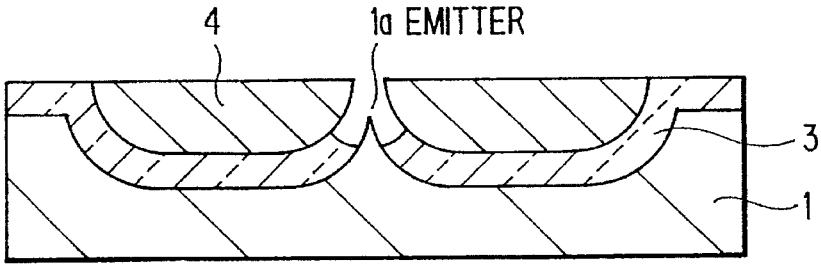

Next, as shown in FIG. 7C, the film 4*a* is thinned by polishing to form a gate electrode 4. Finally, as shown in FIG. 7D, the silicon dioxide film 3 on an emitter 1*a* is etched.

In the third embodiment, the film 4*a* for gate electrode 4 is easily deposited and the silicon dioxide film 3 can well serve as a stopper against the polishing of the film 4*a* to precisely control the level of the upper surface of the gate electrode 4. Herein, the polishing can be performed by the chemical and mechanical polishing (CMP) method.

Figure 8:
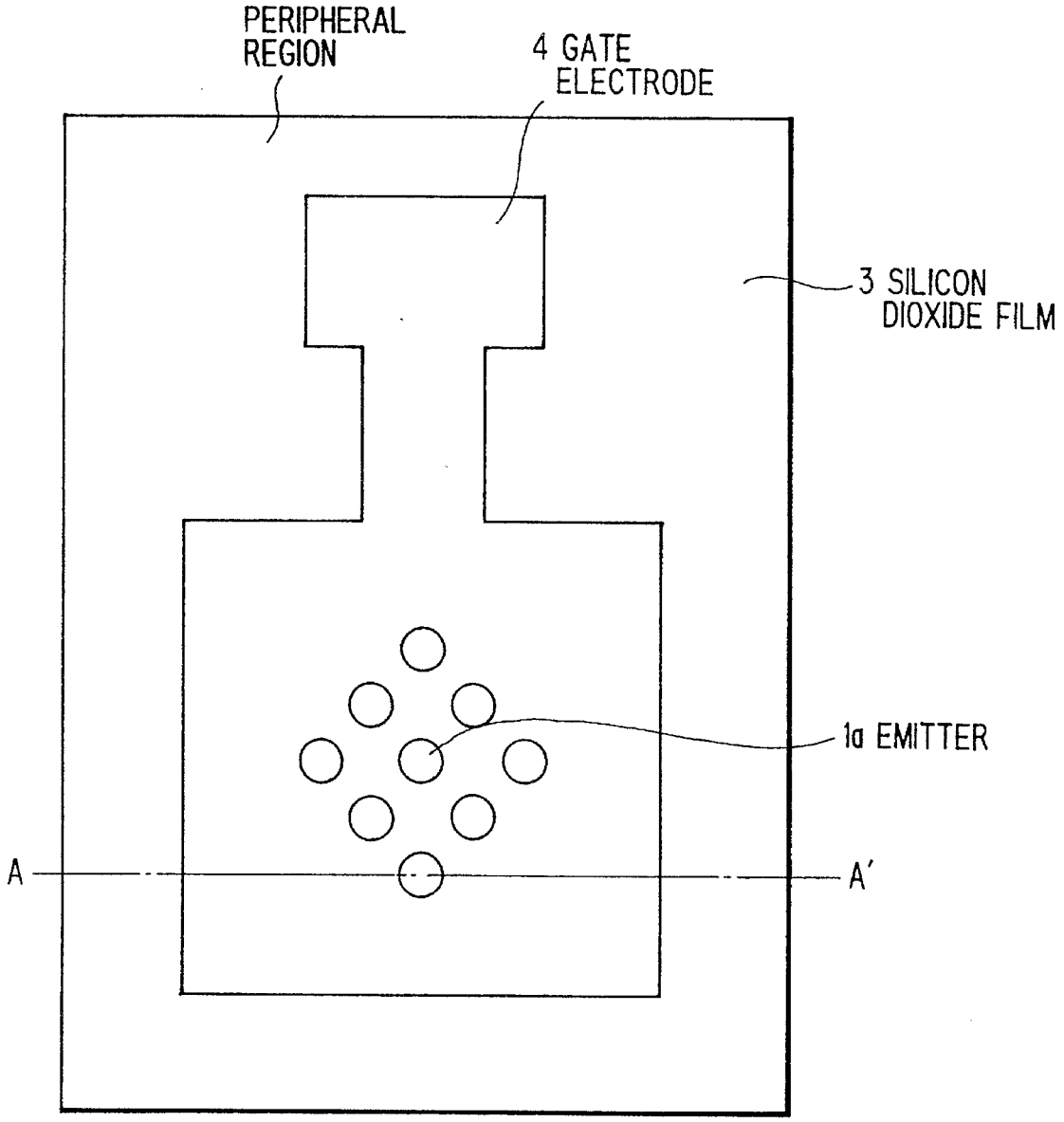
FIG. 8 is a plane view showing the field-emission type electron gun in the third preferred embodiment.

FIG. 8 is a plane view showing the field-emission type electron gun in the third embodiment. Meanwhile, FIG. 7D corresponds to a cross section along the line A—A' in FIG. 8. In this embodiment, the plane figure of the emitter 1*a* is circular, but it is not limited to this figure. The number of the emitters la is nine in this embodiment, but it is not limited to this number.

Although the invention has been described with respect to specific embodiment for complete and clear disclosure, the appended claims are not to be thus limited but are to be construed as embodying all modification and alternative constructions that may be occurred to one skilled in the art which fairly fall within the basic teaching here is set forth.

What is claimed is:

1. A method for making a field-emission type electron gun, comprising the steps of:

a) forming insulating film on a main plane of a silicon substrate;

b) selectively etching said insulating film within a region where a gate electrode will be formed no form a mask of said insulating film;

c) removing said silicon substrate within said region using said mask to form a concave portion, wherein said insulating film remains on an edge of said concave portion and an edge of said insulating film extends in the form of a cantilever from said edge of said concave portion;

d) oxidizing a surface of said silicon substrate by thermal oxidation to form an emitter with a sharpened tip;

e) depositing a film for forming a gate electrode to fill said concave portion;

f) removing an unnecessary part of said film for forming said gate electrode; and g) selectively removing said oxidized surface of said silicon substrate on said emitter to expose said tip of said emitter.

2. A method for making a field-emission type electron gun, according to claim 1, wherein:

said step c) is performed by isotropic etching or anisotropic etching followed by isotropic etching.

3. A method for making a field-emission type electron gun, according to claim 1, wherein:

said step c) comprises anisotropic etching, thermal oxidation of a surface of said silicon substrate and etching of said oxidized surface of said silicon substrate.

4. A method for making a field-emission type electron gun, according to claim 1, wherein:

said insulating film over said emitter is removed after said step c) and prior to said step d).

5. A method for making a field-emission type electron gun, according to claim 1, wherein:

said step f) removing said unnecessary part of said film for forming said gate electrode is performed by polishing or chemical and mechanical polishing.

6. A method for making a field-emission type electron gun, according to claim 1, wherein:

said insulating film over said emitter is removed after said step f) and prior to step g).

* * * * *